US006279924B1

(12) United States Patent
Murphy et al.

(10) Patent No.: US 6,279,924 B1
(45) Date of Patent: Aug. 28, 2001

(54) SNOWBOARD SAFETY RELEASE BINDING

(75) Inventors: Stephen Murphy; David Scallion, both of South Melbourne (AU)

(73) Assignee: Powder Design Pty Ltd., South Melbourne (AU)

( * ) Notice: Subject to any disclaimer, the term of this patent is extended or adjusted under 35 U.S.C. 154(b) by 0 days.

(21) Appl. No.: 09/509,617

(22) PCT Filed: Sep. 30, 1998

(86) PCT No.: PCT/AU98/00825

§ 371 Date: Jun. 12, 2000

§ 102(e) Date: Jun. 12, 2000

(87) PCT Pub. No.: WO99/16515

PCT Pub. Date: Apr. 8, 1999

(30) Foreign Application Priority Data

Sep. 30, 1997 (AU) ..... PO 9546

(51) Int. Cl.[7] ..... A63C 9/08; A63C 9/086

(52) U.S. Cl. ..... 280/14.23; 280/607; 280/613; 280/620; 280/618; 280/14.22

(58) Field of Search ..... 280/14.23, 14.21, 280/14.22, 14.24, 618, 607, 613, 620

(56) References Cited

U.S. PATENT DOCUMENTS

| | | | | |
|---|---|---|---|---|
| 4,652,007 | * | 3/1987 | Dennis | 280/618 |
| 4,955,632 | * | 9/1990 | Giarritta et al. | 280/607 |
| 5,035,443 | * | 7/1991 | Kincheloe | 280/618 |
| 5,069,463 | * | 12/1991 | Baud et al. | 280/14.2 |
| 5,085,455 | * | 2/1992 | Bogner et al. | 280/618 |
| 5,094,470 | * | 3/1992 | Riedel | 280/607 |
| 5,190,311 | * | 3/1993 | Carpenter et al. | 280/618 |
| 5,520,406 | * | 5/1996 | Anderson et al. | 280/624 |
| 5,722,680 | * | 3/1998 | Dodge | 280/624 |
| 5,871,226 | * | 2/1999 | Klubitschko et al. | 280/624 |
| 6,116,636 | * | 9/2000 | Bazzi | 280/624 |

FOREIGN PATENT DOCUMENTS

| | | |
|---|---|---|
| 0335463 | 10/1989 | (EP) . |
| 0352662 | 1/1990 | (EP) . |
| 0373548 A2 | 6/1990 | (EP) . |
| 0397969 A1 | 11/1990 | (EP) . |
| 2651144 A1 | 3/1991 | (FR) . |
| 92/18211 | 10/1992 | (WO) . |
| 96/03185 A1 | 2/1996 | (WO) . |
| 97/16226 | 5/1997 | (WO) . |

* cited by examiner

*Primary Examiner*—Brian L. Johnson
*Assistant Examiner*—Tony Winner
(74) *Attorney, Agent, or Firm*—Harness, Dickey & Pierce, P.L.C.

(57) ABSTRACT

A binding apparatus for a snowboard with which the boots of a snowboarder can be securely attached to the board while permitting release thereof upon application of a force greater than a preselected threshold. If a force of an undesirable magnitude in either a lift-out or torsional direction is applied to either of the snowboarder's boots with respect to the board, then that boot will be released by the binding, and the other binding will also automatically release the other boot. Both boots can also be manually released from the bindings, and one boot can be left secured to the board while the other is released for negotiating ski lifts and the like. The snowboard bindings permit easy step-in entry which will allow the boot to be secured to the binding even in the event of snow or the like being stuck between the boot and binding. A safety brake is also provided which prevents run-away of the board if it is detached from the rider.

5 Claims, 8 Drawing Sheets

SNOWBOARD SAFETY RELEASE BINDING

BACKGROUND OF THE INVENTION

This invention relates to a binding for coupling a rider to a snowboard or the like, in which the binding mechanism is adapted to release the snowboard from the rider in the event of abnormal forces being applied which could result in injury to the rider.

Snowboard riding is increasing in popularity as a sport and recreational activity, and is now a broadly accepted alternative or adjunct to skiing. To date, however, the safety aspects of snowboarding equipment lags behind that developed for skiing, particularly with respect to the binding mechanisms provided to hold the snowboard to the feet of the rider. The form of snowboard binding which is currently most broadly used includes two foot plates fastened to the snowboard, each foot plate having a plurality of straps adapted to fasten around a respective boot of the rider. In use, the rider places his or her boot clad feet on the foot plates and tightens the straps around the boots to secure the board to the rider's legs. In order to remove the board the rider must manually and individually unfasten each of the straps to release the snowboard bindings from the rider's boots.

The United States Consumer Product Safety Commission has released statistics concerning snowboard safety, which indicates that the majority of snowboarding fatalities have resulted from suffocation in deep snow. With the snowboard unreleasably attached to the rider's feet, the length of the snowboard can act as an anchor in the event of a snow slide or avalanche, and once covered in snow the rider may not be able to reach the binding straps in order to remove the board. It may therefore be desirable for a snowboard binding to enable the rider's legs to be released from attachment to the board in the event of abnormal forces being applied, such as may occur in the case of a severe fall or an avalanche.

Ski bindings are designed to release the ski from the ski boot if abnormal forces are applied between the ski boot and ski binding, so that those forces are not transmitted to the skier's leg where they may cause injury. It would be advantageous, therefore, for snowboard bindings to have a similar safety feature, such that the likelihood of injury is decreased in the event of a severe fall, particularly one in which the body or legs of the snowboarder twist relative to the board. In the case of a snowboard binding release, ideally both feet should be released from the board during the fall, even if only one binding initially senses abnormal forces, since with only one leg secured to the snowboard the potential for injury to that leg is greatly increased.

Another difficulty associated with snowboard bindings occurs where the rider wishes to use a conventional ski lift or tow to return to the top of a mountain slope. In order to negotiate queues of people and the like the rider must generally free one foot from the board to manoeuvre into position to mount the ski lift. After alighting from the ski lift the free boot must then be re-fastened to the snowboard. The constant cycle of unfastening and re-fastening the conventional binding straps is both physically exhausting and time consuming, and it would therefore be desirable for an improved snowboard binding to enable easier fixing and release of at least one boot from the board when desired.

SUMMARY OF THE INVENTION

In accordance with the present invention, there is provided a binding apparatus for use with a binding plate secured to or incorporated in the bottom of a respective boot, comprising two binding mechanisms adapted to be secured to a board, platform or the like, the binding mechanisms each comprising a pair of release mechanisms spaced apart in a facing relationship and constructed to, in use, engage at respective sides of the associated binding plate and hold the binding plate to the board, platform or the like, each of the release mechanisms being constructed to release the binding plate from the board upon application of a force to the binding plate with respect to the board which is greater than a respective predetermined threshold in a direction away from the plane of the board and/or in a rotational sense parallel to the plane of the board, wherein the two binding mechanisms are coupled together by way of a cable coupling which interconnects respective release mechanisms of the two binding mechanisms such that, upon release of a binding plate from one of the binding mechanisms, a tension in the cable coupling causes the respective release mechanism of the other binding mechanisms to release the corresponding binding plate therefrom, and wherein each of the binding mechanisms includes a manual release mechanism which acts on one or both of the corresponding release mechanism to voluntarily release the respective binding plate arranged whereby manual release of the binding plate from one of the binding mechanisms causes automatic release of the binding plate from the other binding mechanisms via the cable coupling while manual release of the binding plate from the other of said binding mechanisms prevents an automatic release of the binding plate from said one of the binding mechanisms.

In another aspect, there is provided a binding apparatus for securing a binding plate attached to or incorporated in the bottom of a respective boot to a snowboard or the like, comprising two binding mechanisms each having a pair of spaced release mechanisms arranged to, in use, latch onto and secure respective side portions of the associated binding plate when the binding plate is positioned in the binding, each release mechanism having a spring-tensioned release means which permits a forced release of the binding plate upon application to the binding plate of a predetermined separation force and/or torsional force, the two binding mechanisms being coupled together by way of a cable coupling which, upon application of a change in tension thereto at one of the binding mechanisms, facilitates unlatching of a release mechanism at the other binding mechanism, wherein each binding mechanism further include a sensing means coupled to a respective latch mechanism of the other binding by way of the cable coupling so that, in normal operation, the removal of a binding plate from one of the binding mechanisms facilitates the release of the binding plate from the other binding mechanism, and wherein each binding mechanism includes a manual release mechanism to effect voluntary release of the respective binding plate therefrom arranged whereby the manual release mechanism and cable coupling at one binding mechanism allows release of that foot whilst the other foot remains secured in its binding mechanism, and manual release at the other binding mechanism causes automatic release of both feet.

As will be appreciated from the following detailed description, the preferred construction of the present invention provides a snowboard binding arrangement having a number of significant advantages over the known prior art, such as:

i) a dual release capability, wherein the forced release of either foot from the binding facilitates the release of the other foot as well;

ii) the ability to release the rider's foot from the binding upon application of an undesirable separation (lift-out)

force, torsional force or some combination of those forces between the snowboard boot and binding;

iii) proportional adjustment of the lift-out and torsional release forces for each foot;

iv) the ability to step into and engage the binding with each foot using effective locating aids;

v) the provision of an easily accessible manual release mechanism which can be activated by the user to manually release both feet simultaneously;

vi) a self-resetting manual release mechanism for overriding the dual release system to allow the user to remove one foot whilst the other remains engaged, for negotiating ski lifts and the like (i.e. the back foot can be voluntarily removed from the binding without releasing the front foot, and can be replaced to reactivate the dual release system);

vii) a simple fitting to the boot worn by the user and which allows the use of existing snowboard boots, viii) a total binding construction which is relatively lightweight and easily operated;

ix) a locking mechanism that enables securing the rider's feet even when snow or other hindrance is under the boot;

x) An entry system that preloads the clamping mechanism such that the rider feels no unwanted free movement;

xi) A brake that is adjustable for various board sizes;

xii) A mounting system that has a reduced contact area with the board so as to reduce interference with the snowboard flex.

BRIEF DESCRIPTION OF THE DRAWINGS

The invention is described in greater detail hereinafter, by way of example only, with reference to a preferred embodiment thereof illustrated in the accompanying drawings, wherein.

DESCRIPTION OF PREFERRED EMBODIMENTS

Figure 1:
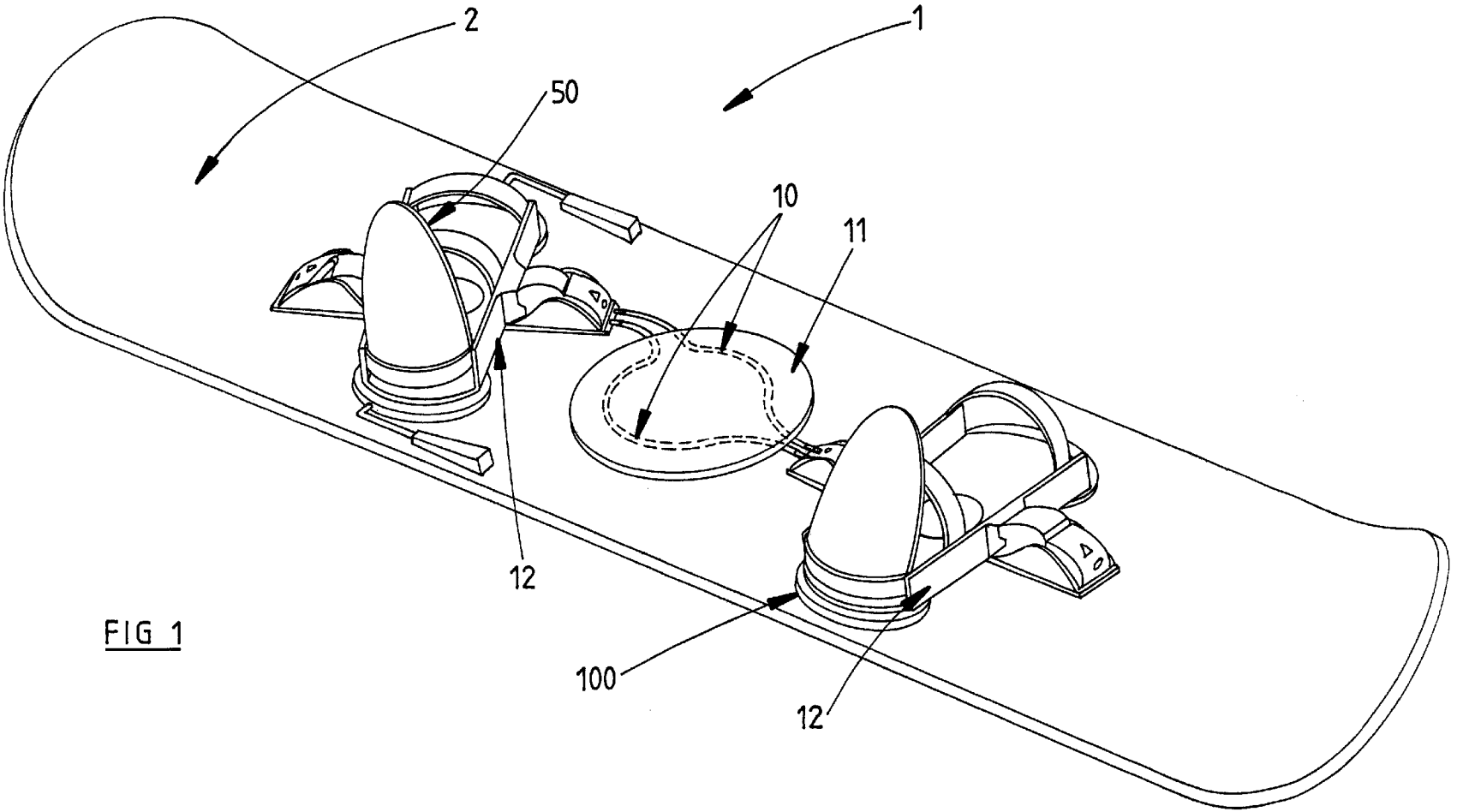
FIG. 1 is an elevated rear isometric view of a snowboard fitted with a binding apparatus, having binding plates mounted thereon, constructed in accordance with a preferred embodiment of the invention.
Figure 2:
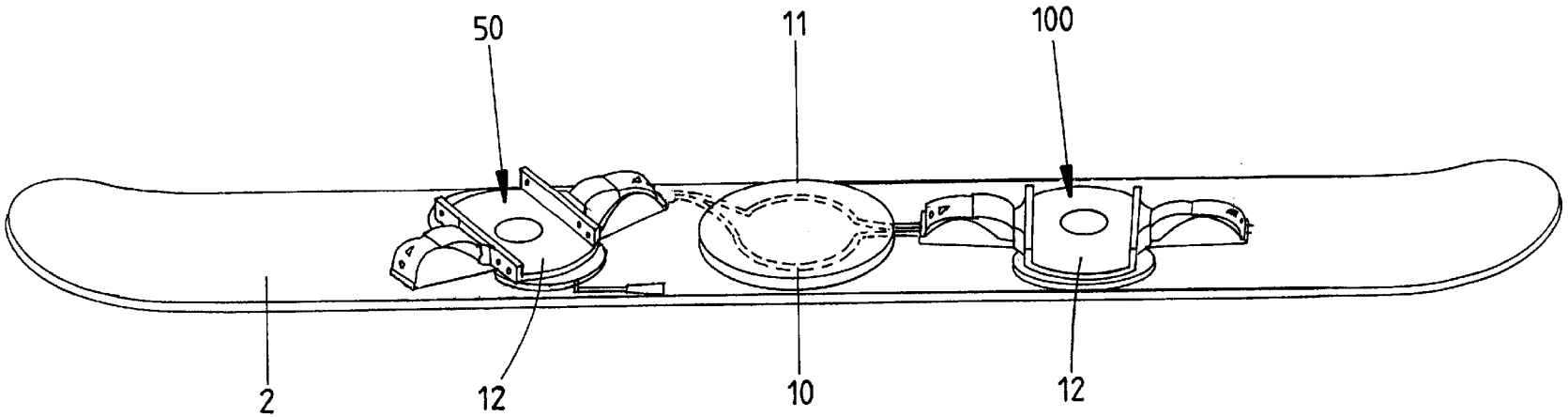
FIG. 2 is an elevated side isometric view of the snowboard of FIG. 1.

A snowboard 2 is illustrated in FIGS. 1 and 2, fitted with a binding apparatus according to a preferred embodiment of the present invention. The snowboard 2 itself is of conventional form, comprising a generally flat, elongate board structure with tapered or rounded and upturned ends. The bottom surface of the board 2 (not shown in the drawings) is constructed to contact and slide over snow and ice, whilst the top surface of the board is constructed to allow binding fixtures to be fitted thereto to enable the user to secure his or her boots to the board. The side edges of the board are substantially parallel, and the board itself is generally symnmetrical with respect to both the sideways and end-to-end axes. Thus, the "front" and "back" of the board (as designated in the Figures) is primary determined by the mounting of the bindings, as discussed in greater detail hereinbelow, rather than the actual shape of the board itself, although more directionally oriented board constructions are of course possible. The board 2 is of the order of 1.5 meters long and 30 centimeters wide, although it will be appreciated that a significant range of different sized boards may be available depending upon the size of the user, the conditions, the specific use, and personal preference, amongst other things.

The binding apparatus fitted to the snowboard 2 comprises a front binding 50 and a rear binding 100 which are both, in use, mounted on the upper surface of the board 2 as shown in the Figures. The front binding 50 is mounted toward the "front" of the board 2, and the rear binding 100 is of course mounted toward the '"rear" end of the board. The front and rear bindings are coupled together by way of a flexible cable coupling 10. Where the cabling extends between the front and rear bindings it may pass under or through a central pad 11 mounted on the surface of the snowboard between the two bindings, so as to minimise the possibility of entanglement of the cables. In the construction shown in FIGS. 1 and 2, the front binding 50 is arranged to secure the left foot of the rider, and the rear binding 100 is arranged to secure the right foot, so that the rider, in use, faces substantially toward the right-hand side of the snowboard 2 as illustrated when viewed from above. Both the front and rear bindings are mounted to the board so that the rider's boots, when secured to the respective bindings, extend transversely of the length of the board 2. The rear binding is shown positioned so that the rider's right foot extends, in use, generally at right angles to the board's longitudinal axis. The front binding is positioned so that the rider's left foot, in use, points somewhat toward the front of the board. The orientation of the bindings with respect to the axis of the board is, however, adjustable for each of the front and rear bindings individually, which is explained in greater detail hereinbelow.

Both of the front and rear bindings 50, 100 are shown in FIGS. 1 and 2 with respective binding plates 12 mounted therein. Each binding plate 12 is operatively affixed to a respective boot (not shown) which is in use worn by the rider, and the binding plates shown in FIG. 1 includes the straps and the like necessary to affix the binding plate to the boot. As will be described in detail hereinbelow, it is the binding plate which is operatively secured to the binding and which is releasable from the binding in the event of abnormal forces being applied. Thus, the binding plate 12 is itself affixed securely to the rider's boot so that a coupling between the binding and binding plate can secure the boot, and thus the rider, with respect to the snowboard 2. The form of the binding plate utilised in the preferred embodiment of the present invention is relatively simple, which allows significant versatility in that the binding plate can attached to a conventional soft structure snowboard boot, or the operative portions of the binding plate can be incorporated into a snowboard boot specifically constructed for the binding of the present invention. For example, the binding plate 12 illustrated can be attached to a conventional snowboard boot by way of a conventional snowboard binding of the type described briefly hereinabove. The binding plate may be affixed to the bottom of the conventional strap-secured binding with screws, bolts or the like in the same way the binding would ordinarily be attached to the snowboard itself. In this instance, however, the use of the conventional binding is not subject to the drawbacks discussed above, since the binding plate and thus the conventional binding is releasable from the board, and the straps need only be manipulated when donning or removing the boots themselves by the rider. Furthermore, this arrangement allows the rider to make the transition to the binding of the present invention whilst still retaining the boots which the rider has become familiar with.

Figure 3:
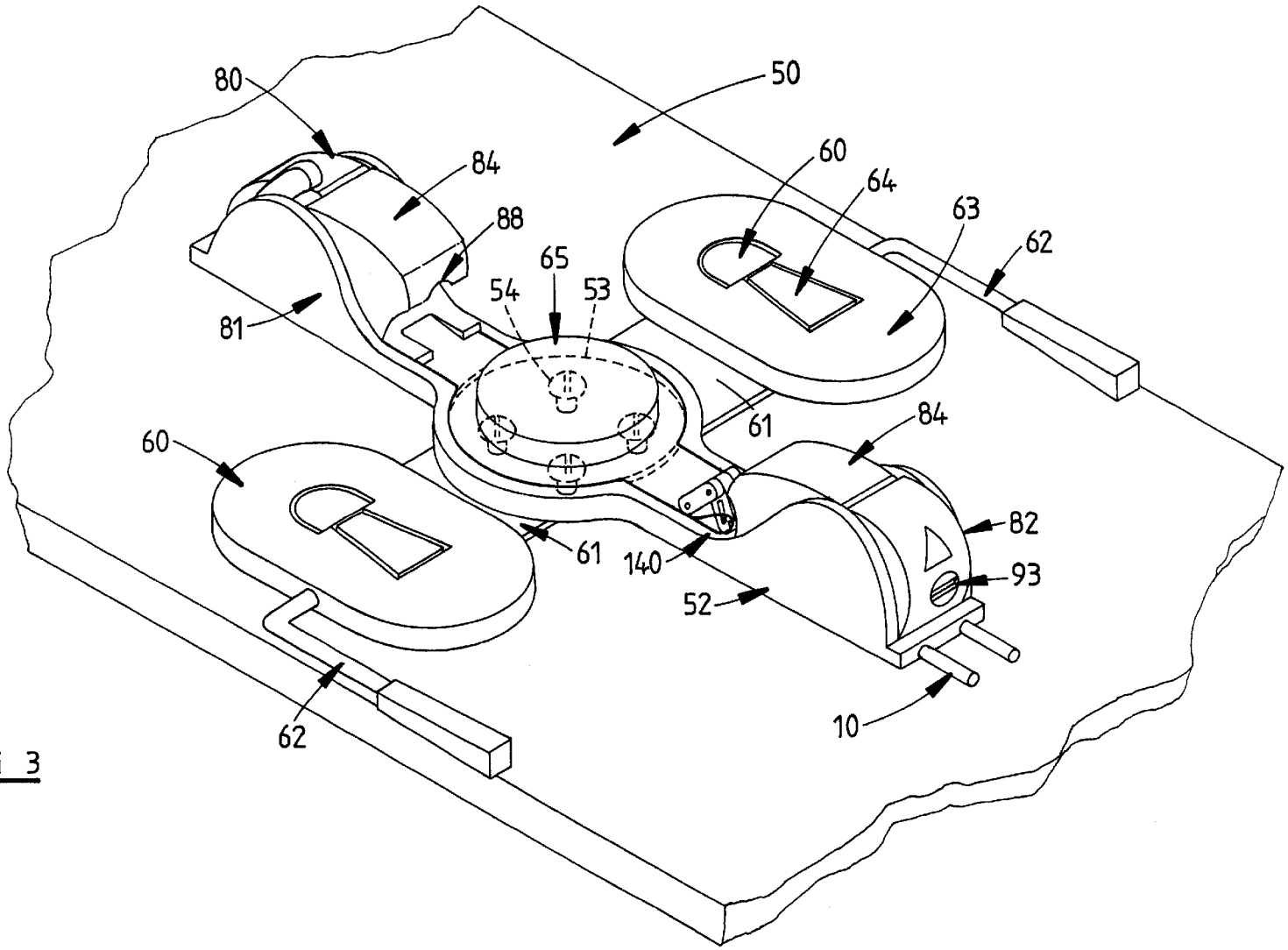
FIG. 3 is an elevated isometric view of the front snowboard binding of the preferred embodiment.

A more detailed view of the front binding 50 without the binding plate attached is shown in FIG. 3. The binding 50 includes a base plate 52 which is generally cross-shaped and has a substantially flat profile with a raised central locating cylinder formation 65. A mounting plate 53 located in the centre of the base plate 52 beneath the locating cylinder 65, allows mounting bolts or screws 54 to extend therethrough and into the snowboard 2. The screws or bolts 54 which pass through the mounting plate 53 and into the upper surface of the snowboard secure the binding 50 against the snowboard upper surface when the screws 54 are tightened so that the heads or flanges thereof bear against the mounting plate 53 which clamps the base plate 52 against the snowboard surface. The mounting plate has a circular construction with peripheral teeth formations which interfit which complementary teeth on the base plate. If the screws 54 are loosened, then the teeth on the mounting plate can be disengaged from the base plate to allow the rotational orientation of the binding 52 to be adjusted with respect to the snowboard 2. Two brake mechanisms 60, provided at the front binding only, are disposed toward the respective edges of the snowboard to from the centre of the binding plate. The brake mechanisms are also secured by the mounting plate, but are not rotatably adjustable with the remainder of the base plate. The screws 54 pass through elongate slots in extensions of the brake mechanisms 61 which extend beneath the centre of the base plate 52. Thus, when the screws are tight the mounting plate clamps both the base plate and brake mechanisms in position, but when the screws are loosened the lateral position of the brake mechanisms are adjustable to accommodate different width snowboards. In use, the extensions 61 are adjusted so that each brake mechanism is positioned adjacent its respective edge of the snowboard.

Figure 7:
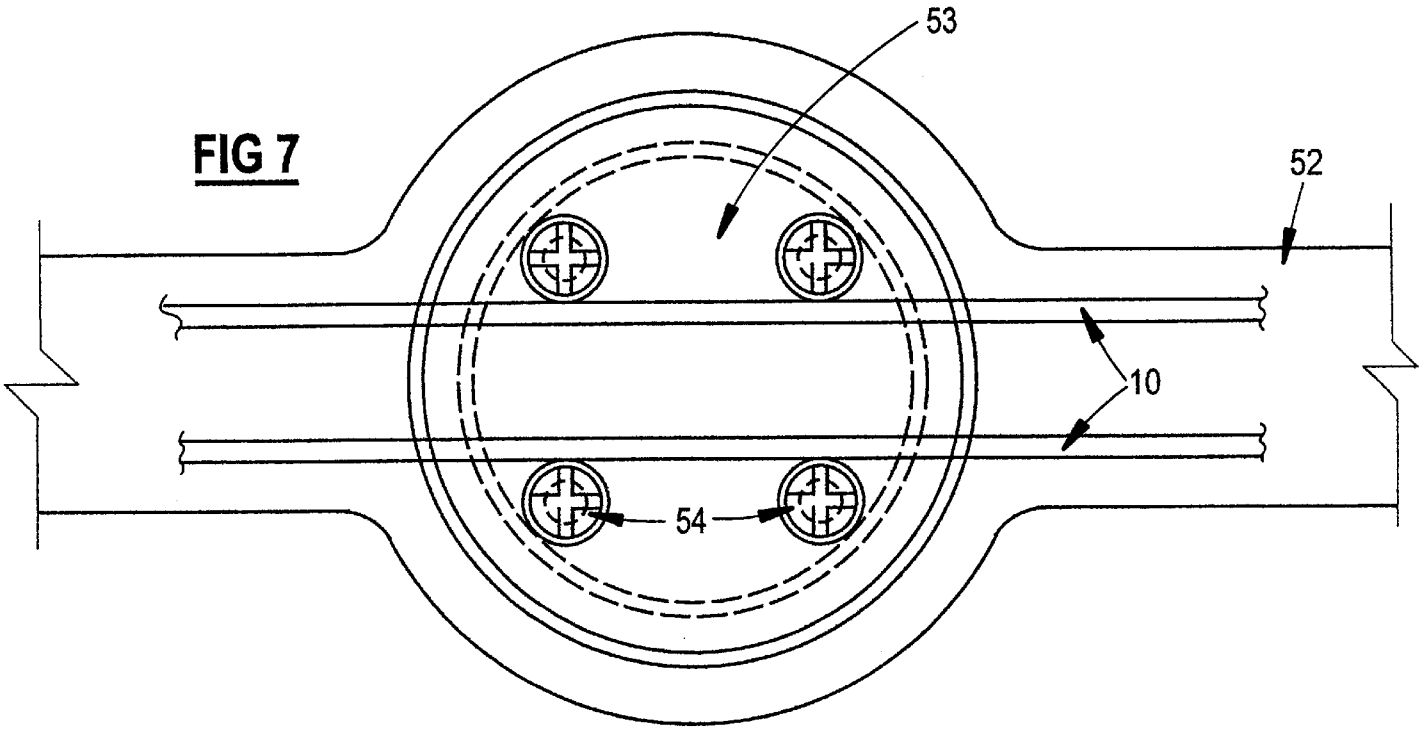
FIGS. 7 and 8 are plan and cross-sectional views of the binding mechanism base plate.
Figure 8:
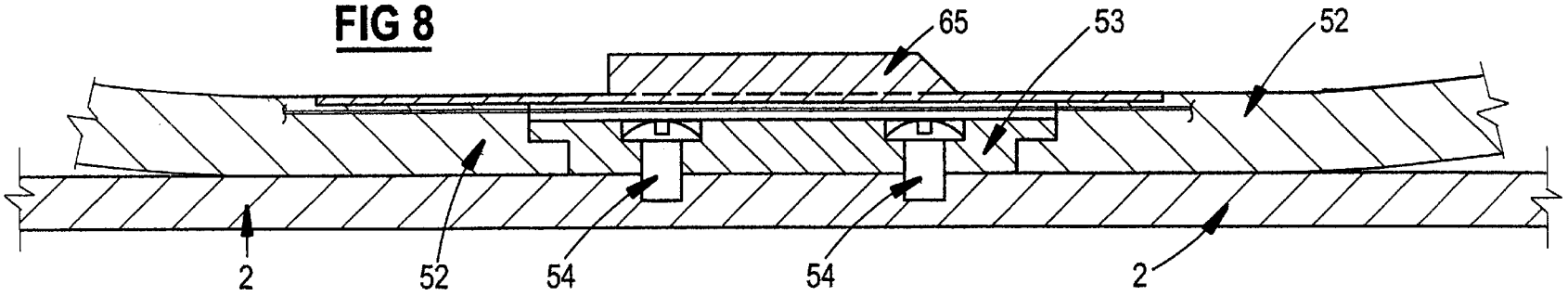

The centre portion of one binding is shown in plan an cross-sectional views in FIGS. 7 and 8, respectively. As can be seen in these drawings, the coupling cables 10 may pass over the mounting plate 53 and beneath the cover plate from which the guiding cylinder 65 projects in the centre of the binding. FIG. 8 also illustrates the manner in which the arm portions of the base plate which support the release mechanisms are raised slightly away from the surface of the snowboard, so that the binding does not interfere with the flex of the snowboard any more than a conventional snowboard binding.

Each brake mechanism 60 comprises a foot pad 63 upon which the bottom of the binding plate or rider's boot is positioned when mounted in the binding. A braking arm 62 extends from the foot pad adjacent the snowboard edge, and is capable of pivotable movement of the free end thereof across the upper surface of the snowboard 2 and downwardly over the edge to which it is adjacent to in use engage the snow and slow or prevent the snowboard from sliding.

Although the braking arm 62 is shown in FIG. 3 in its retracted position, which is the position of the brake during use of the snowboard binding with the rider's foot positioned in the binding, the brake mechanism is in fact spring biased to an extended position. The extended position of the braking mechanism is the braking position (not shown) in which the brake arm 62 extends from the edge of the snowboard to stick into the snow underneath the snowboard to slow or prevent the snowboard from sliding over the snow surface. The braking arm 62 is coupled within the foot pad 63 to a sensor pad structure 64 which is spring biased to project above the surface of the foot pad 63 when the braking arm is in the extended position. The brake mechanism operates as follows. When the boot or binding plate is not mounted in the binding, the braking arm 62 is in the extended position and the sensor pad structure 64 projects from the foot pad by virtue of the spring bias. When the binding is in use, the boot or binding plate forces the sensor pad structure 64 downward against the spring bias where it is held in place by the boot. This action causes the braking arm to retract through the mechanical coupling which pivots the end of the braking arm upwards, and draws the braking arm over the edge of the snowboard. This movement is accomplished through a camming action by interfitting portions of the sensor pad structure and braking arm within the foot pad 63. Thus, the ski brake mechanism 60 extends into its braking position when the rider's foot is removed from the binding 50, and is a safety feature which prevents the snowboard from sliding over the snow without a rider.

Given the possible variations in mounting orientations of the binding 50 with respect to the snowboard 2, features of the binding discussed in detail hereinbelow are described with a frame of reference of the orientation of the intended position of the user's foot when secured in relation to the binding. Thus, reference may be made to the toe and heel sections of the binding, or to the left and right portions thereof, and the left and right portions of each binding will not necessarily correspond to the left and right sides of the snowboard 2 referred to above when the binding is affixed thereto.

Figure 6:
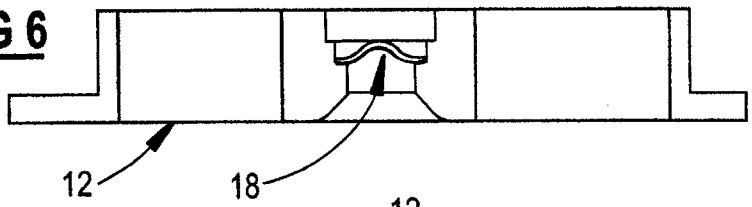
FIGS. 4, 5 and 6 are various views of the binding plate.
Figure 4:
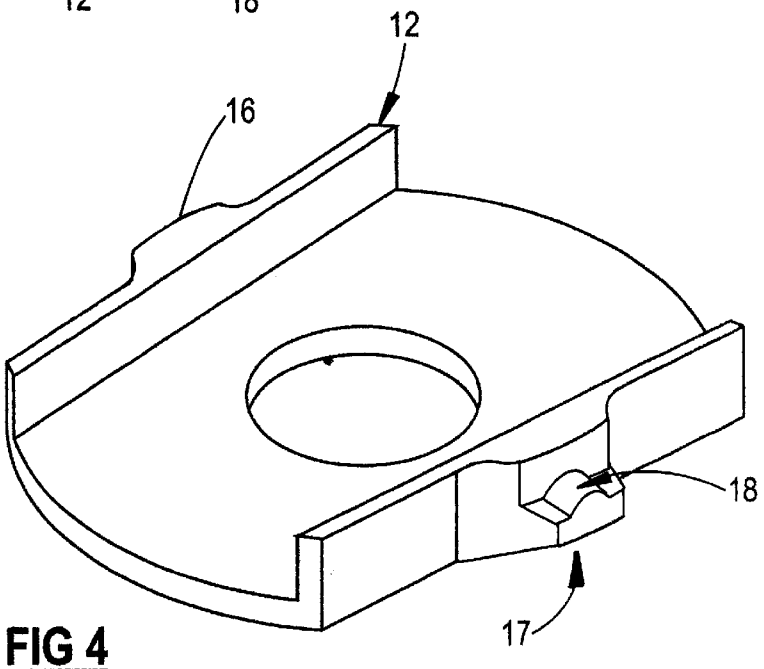
Figure 5:
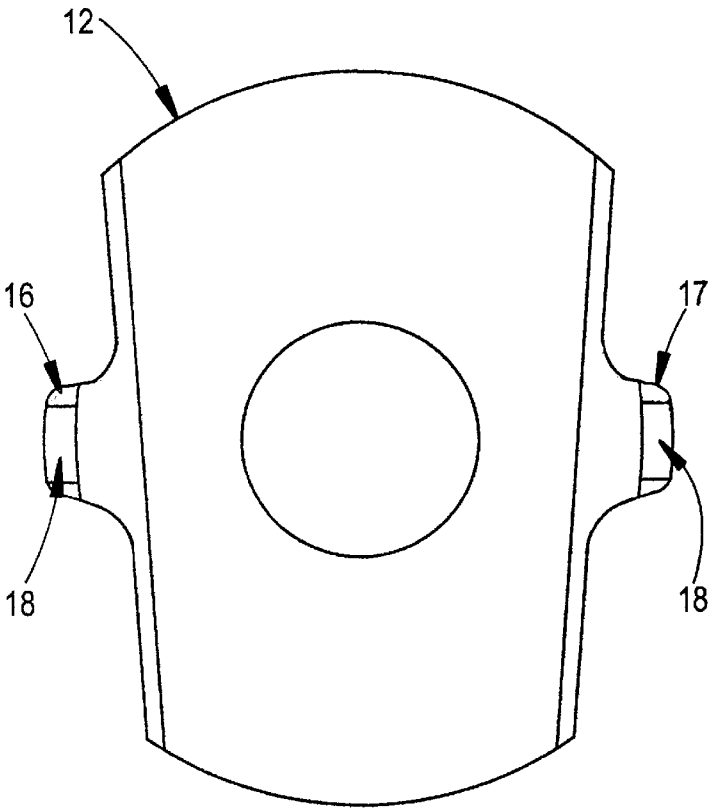

The binding plate 12 is shown in greater detail in FIGS. 4, 5 and 6, and comprises a generally rectangular plate having opposing side location protrusions 16, 17, and a central circular hole to interfit with the locating cylinder 65. The binding plate may be fastened to the bottom of a conventional snowboard boot using a plurality of straps or other secure fastening devices. Alternatively, the binding plate may be integrated into the bottom of a purpose built snowboard boot. The protrusions 16, 17 are located centrally on the sides of the binding plate and are constructed with cam surfaces 18 to interfit with the snowboard binding as described in greater detail hereinbelow. The cam surface on each protrusion is formed with a generally triangular profile, so that the upper surface of the protrusion is raised in the centre and slopes downwardly in the front and rear directions of the binding plate, and also slopes slightly downwardly in the direction extending away from the binding plate.

On the left and right "arms" of the cross-shaped base plate 52 shown in FIG. 3, there are mounted respective release mechanisms 80 and 82. The left and right release mechanisms 80, 82 are substantially the same in construction for the purposes of a forced release from the binding, although differences exist for the purposes of a manual release as will be described in detail below. The release mechanisms are mounted on the respective left and right arms of the base plate 52 and have respective release blocks 84 which face inwardly toward the centre of the binding base plate 52. A release mechanism is also shown in partial cross-section in FIGS. 9 and 10 to facilitate explanation of the forced release function of the binding.

The release block 84 has an overhanging extension which protrudes toward the centre of the base plate. On the underneath of the overhanging extension there is formed a recessed cam surface 85 which is complementary in shape to that formed on the protrusions of the binding plate. When the binding plate is mounted in the binding the respective protrusions 16, 17 of the binding plate interfit with the recesses in the left and right release blocks, and the binding plate is thereby held in place in the binding against the base plate 52.

Figure 9:
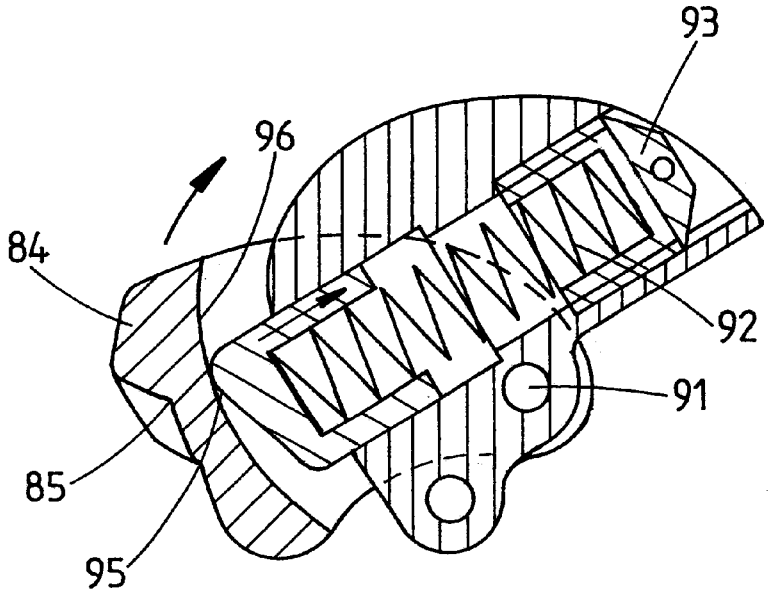
FIGS. 9 and 10 are side cross-sectional views of the force release mechanism of the preferred embodiment binding.
Figure 10:
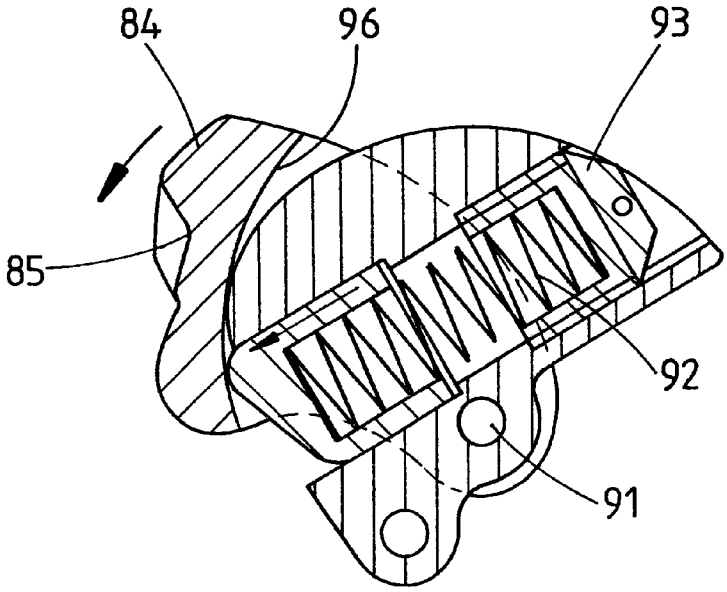

Referring particularly to FIG. 9 and 10, the release block 84 is mounted to allow pivotal movement thereof about a pivot axis 91. With the binding plate secured in the binding the release block 84 is in the lower pivotal position as shown in FIG. 9. The release block 84 is then able to pivot upwardly as shown in FIG. 10 which allows the respective protrusion of the binding plate to escape from the recess 85 of the release block. The release block is biased toward the lower position by the use of a compression spring 92 which provides a force between the end stop 93 of the release mechanism and a slidably moveable cam member 94. The end 95 of the cam member 94 bears against an internal surface 96 of the release block 84 by action of the compression spring 92. The internal surface 96 of the release block is of substantially constant curvature about an axis which is positioned above the pivot axis 91 of the release block. This structure enables the force of the compression spring 92 to be transmitted to the release block 84 as the release block pivots upwardly. Thus, as the release block pivots up the cam member is forced against the action of the spring 92, which causes the release block 84 to be biased toward the pivotally downward position (FIG. 9). The force provided by the compression spring can be adjusted using the end stop 93 which is rotatable on a screw thread to allow adjustment toward or away from the release block, therefore compressing or releasing the force on the spring to a limited extent.

In order to enable safe release of the rider from the snowboard binding when excessive lifting and/or twisting forces are applied, the release mechanisms are constructed to enable release of the binding plate from the binding when either rotational and/or lifting forces on the binding plate with respect to the board and binding exceed respective thresholds. These thresholds are determined by the compression spring force which is adjustable using the end stop 93 described above, and may be indicated on a release force indicator (not shown in the drawings). For example, if a rotational force is applied to the binding plate with respect to the snowboard, the sloping cam surfaces of the binding plate protrusion 16, 17 bear against the complementary cam surfaces 85 of the release block 84, and when the force is great enough to overcome the compression spring 92 the release block pivots upwardly against the spring bias. The rotational force on the binding plate then causes the binding plate protrusions to clear the release blocks so as to be released from the binding. Similarly, a sufficient upward force applied by the bindings plate protrusion 16, 17 on the underneath cam surface of the release block also causes the block 84 to pivot upwardly to allow the protrusion to clear the release block overhang and release the binding plate from the binding.

As described above, the same spring 92 controls the force required for forced release from the binding in both lift-out and rotational separations. The rotational and lift-out forces required for release are therefore proportional to one another, and the actual ratio of release forces is dependant upon the slope of the complementary cam surfaces 18 and 85 on the protrusions and release blocks. A shallower slope of the cam surfaces reduces the rotational release force as compared to the lift-out force, and a steeper cam surface slope relatively increases the rotational release force.

Figure 11:
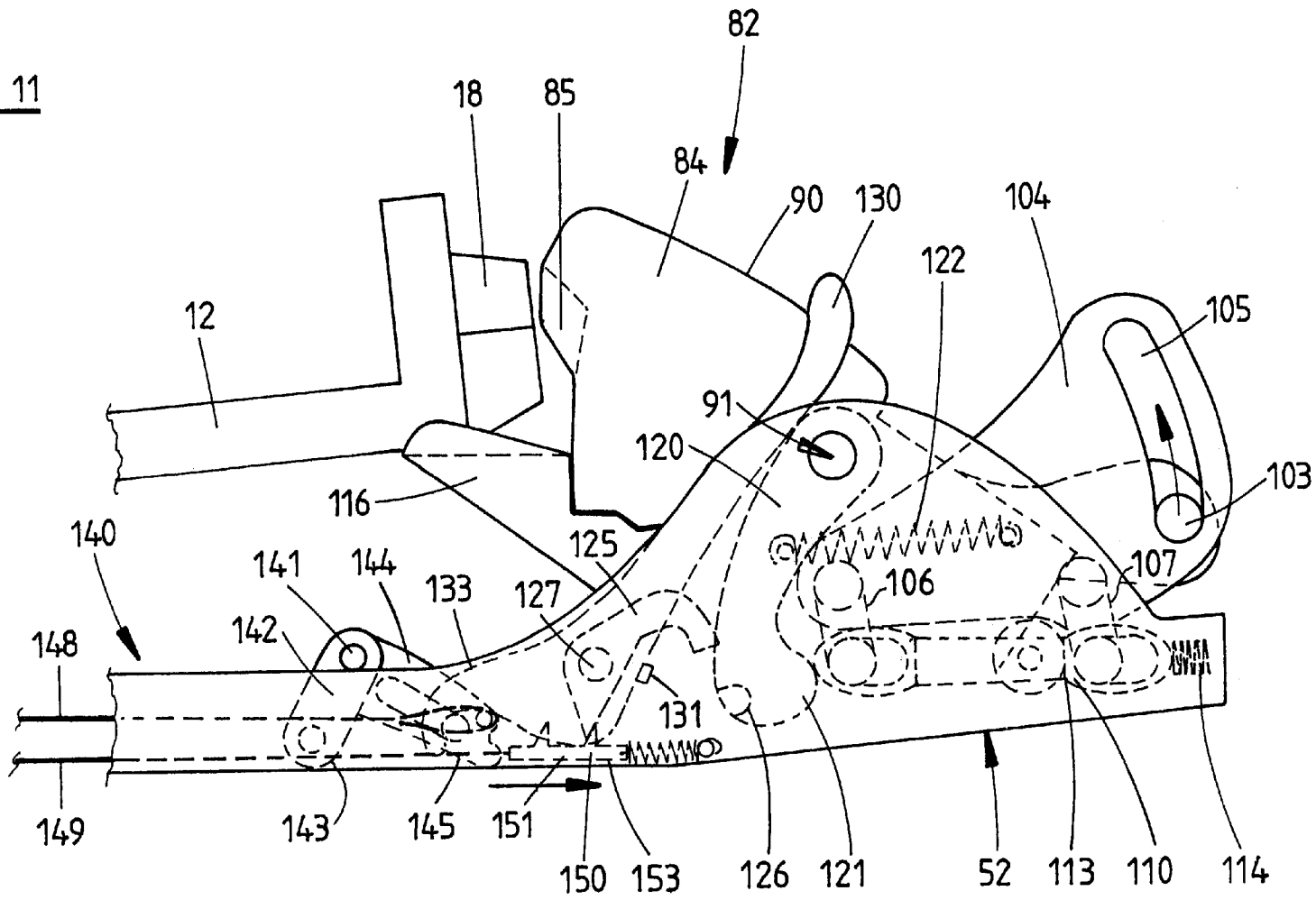
FIGS. 11 and 12 are side partial cross-sectional views of a binding release mechanism illustrating the manual and dual release mechanisms.
Figure 12:
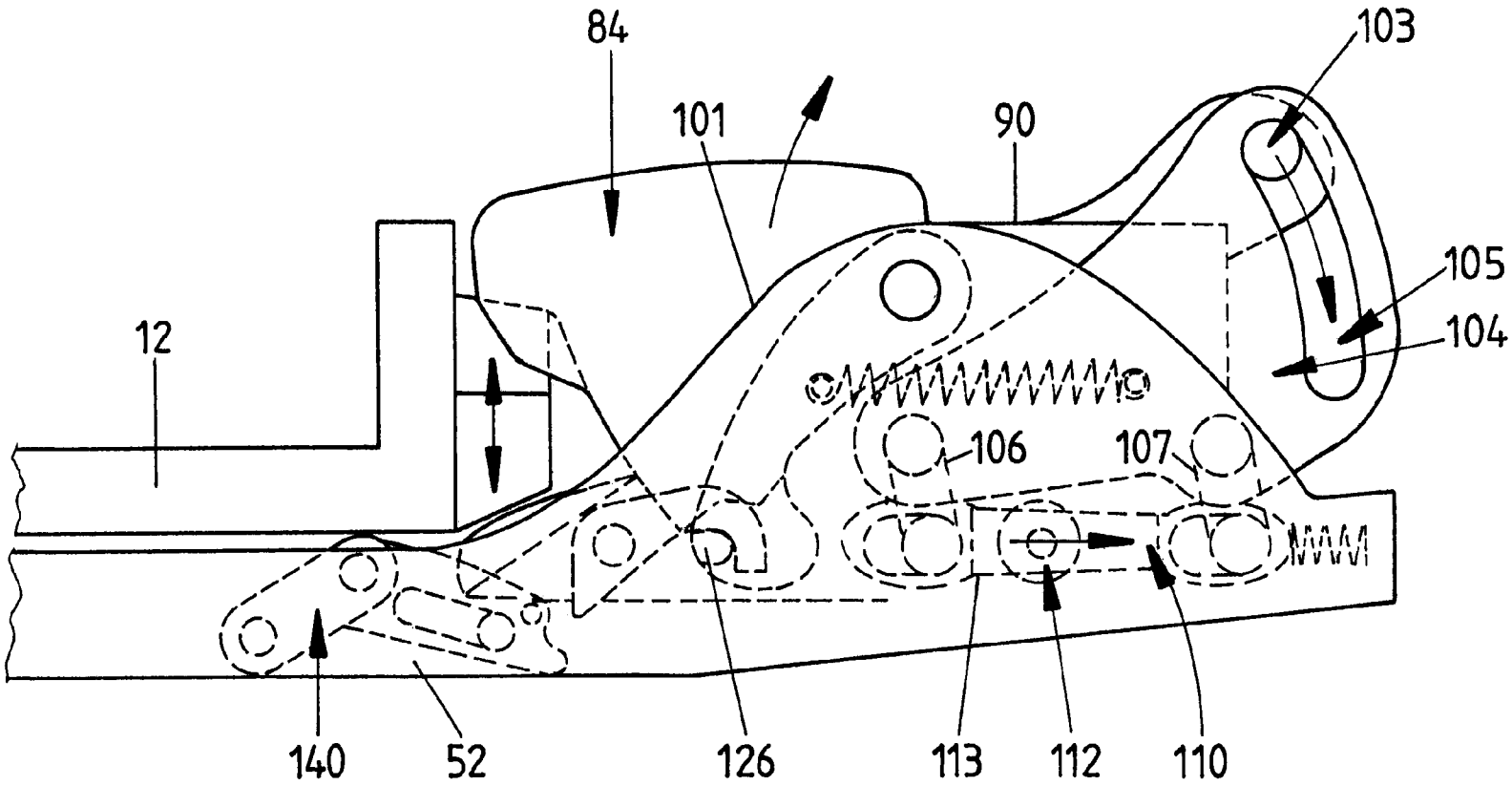

As mentioned, for the purposes of the forced release function of the bindings the left and right release mechanisms operate in the same way. However, in order to enable mounting of the binding plate in the binding, manual release of the binding and the dual release function of the front and rear bindings, one of each of the release mechanisms of the front and rear bindings are constructed with additional features as described below. FIGS. 11 and 12 are side views of the right release mechanism of the rear binding, showing internal workings thereof. The corresponding release mechanism on the front binding, is constructed substantially the same, with some minor differences which will be explained below.

In FIGS. 11 and 12 a bindings mechanism 100 is shown in side view with internal construction illustrated. The binding mechanism 100 is mounted to the base plate 52 of the binding, and has a release mechanism as described hereinabove including a release block 84 which is pivotal about pivot axis 91. The entire release mechanism is also pivotal about the axis 91 between upper and lower pivotal positions shown in FIGS. 11 and 12 respectively. The pivot axis 91 is provided by an axle pin which pivotally couples the release mechanism to a pair of upward extensions 101 of the base plate 52 which extend adjacent the sides of the release mechanism. The rear of the release mechanism is provided with a lug 103 extending transversely therefrom. To the rear of the pivot axis 91 there is also provided a release guide plate 104 having an arcuate slot 105 formed therein within which the lug 103 is moveable. The release guide plate 104 has pivotal connections to the ends of two longitudinally spaced arms 106, 107. The other ends of the arms 106, 107 are coupled at respective ends of a longitudinally moveable carriage 110 positioned between the bottom of the guide plate 104 and the end of the base plate 52. The ends of the arms 106, 107 which are connected to the carriage 110 are pivotally coupled in slightly elongate slots formed in the carriage side, and between the slots the carriage supports a transversely arranged rod or roller 112. The carriage is longitudinally moveable to carry the rod or roller 112 to move within a space 113 which is formed between the bottom edge of the guide plate 104 and a top surface of the base plate 52. The aforementioned components are constructed so that the space 113 is tapered slightly in the longitudinal direction toward the axis 91. The dimension of the slot is dependant upon the positioning of the guide plate 104, which positioning is constrained by the arms 106, 107 and affected by forces acting upon the rear edge of the arcuate slot 105 by the lug 103. The carriage 110 is also spring biased by compression spring 114 so as to urge the rod or roller 112 under the guide plate in the longitudinal direction toward the pivot axis 91. Furthermore the whole release mechanism is itself spring biased about pivot axis 91 (not shown) toward the upward pivotal position shown in FIG. 11. The upward pivotal position of the release mechanism (FIG. 11) is the released position which allows the binding plate 12 to be removed from the binding, and in use the release mechanism is held down in the downward pivotal binding position (FIG. 12) by action of the guide plate and carriage/roller as will be described below.

As mentioned, the release mechanism is spring biased toward the released position (FIG. 11), which is the configuration allowing the user to mount the binding plate and boot to the binding. In use the binding plate is positioned with one of the protrusions in the recess of the release block (e.g. 88 in FIG. 3) of the binding mechanism opposite the manual release binding mechanism 100. That positions the other binding plate protrusion adjacent the cam recess 115 (FIG. 11) with the edge of the binding plate on a ledge 116 which extends from the release mechanism beneath the cam surface of the release block. By pressing down on the binding plate, the binding plate bears down on the pivotal release mechanism which causes the whole release mechanism to pivot about the pivot axis 91. The motion of the release mechanism causes the lug 103 to bear on the edge of the arcuate slot 105 in the guide plate 104. The force of the lug on the slot edge causes movement of the guide plate under the constraint of the arms 106, 107 which slightly widens the space 113. Because the carriage carrying the rod or roller 112 is urged by the spring 114, the rod/roller 112 moves under the guide plate lower edge until it is wedded therein between the bottom of the guide plate and the base plate. The mechanical couplings between the guide plate and carriage, the wedging of the rod/roller in the under the guide plate, and the force of the edge of the arcuate slot 105 on the lug 103 therefore locks the release mechanism in position against the spring bias thereon. Thus, as the release mechanism moves pivotally downward toward the position illustrated in FIG. 12 it is continually prevented from pivoting back up with the spring bias by the wedging action of the rod/roller in the tapered space 113. This is an advantageous arrangement because it allows the binding plate to be secured in the binding, with the protrusion thereof held in the release block recess, even if the bottom of the binding plate is not completely flat against the base plate which can occur if built up snow or other material is present between the binding plate and base plate.

The binding mechanism 100 also includes a hammer member 120 which pivots about the axis 91 and has a hammer end 121 aligned with the end of the carriage 110. Intermediate the pivotal mounting and hammer end 121 the hammer 120 is coupled by a tension spring 122 to the release mechanism. The tension spring 122 provides a biasing force on the hammer so that, with the release mechanism in the released position (FIG. 11) the hammer end 121 bears against the carriage 110 to force the carriage and rod/roller against the compression spring 114 so that the rod/roller is not wedged in the under the guide plate. As the release mechanism is pivoted down a cam member on the guide plate acts on the hammer so as to withdraw the hammer end against the force of the tension spring 122 to place the hammer in a retracted position illustrated in FIG. 12. The hammer is held in the retracted position by a hooked latch member 125 which hooks over a lug 126 formed adjacent the hammer end 121. The hammer in the retracted position places the tension spring 122 in an extended, loaded configuration. With the hammer in the retracted position, the release mechanism is in the binding position (FIG. 12) and the carriage 110 positioned so that the rod/roller is wedged in the space 113, preventing upward pivotal movement of the release mechanism. It should be noted that, even though the release mechanism as a whole is prevented from upward pivotal movement about pivot axis 91, the release block 84 is nevertheless able to pivot up to effect a forced release of the binding plate, as described in connection with FIGS. 9 and 10. When the hammer is released from the retracted position by releasing the latch member 125, as described below, the hammer pivots about axis 91 under action of the loaded tension spring 122 such that the hammer end strikes the end of the carriage to drive and hold the rod/roller out of the wedged engagement under the guide plate and allow the upward pivotal movement of the release mechanism.

The latch member 125 controls both the manual release function of the binding and the dual release function, as described below. The manual release is effected bit a manual release lever 130 which pivots on the same axis 127 as the latch member. The manual release lever 130 is shown in FIG. 11. A free end of the manual release lever extends from the binding mechanism so as to be actuable by the user by levering it toward the binding centre. The manual release lever is provided with a lug 131 which bears against the edge of the latch member adjacent where the latch member hooks over the lug 126 of the hammer. Thus, the levering action of the manual release lever by the user causes the lug 131 to draw the hooked latch member 125 away from the hammer lug 126, which releases the hammer to thereby release the binding as described above.

The dual release function of the binding utilises some additional mechanisms including the cable couplings between the front and rear binding mechanisms which are mentioned above. Adjacent the pivot axis 127 of the latch member and manual release lever, a hinged sensor plate 140 is supported by the base plate 52. The sensor plate 140 has first and second portions 142, 144 which are hinged together at mutually coupled edges 141. The other edge 143 of the first portion 141 is pivotally mounted to the base plate, whilst the remaining edge 145 of the second portion is longitudinally slidable within the base plate toward the first portion edge 143, and is also able to pivot. With the second portion edge 145 of the sensor plate disposed to its full extent toward edge 143, the hinged centre 141 of the sensor plate 140 projects above the surface of the base plate 52 such as is shown in FIG. 11. The sensor plate can of course only project above the base plate surface if the binding plate is not mounted in the binding. Thus, the longitudinal position to which the sensor plate edge 145 can slide is determined by whether or not a binding plate is mounted in binding to prevent the sensor plate from moving.

The slidable edge 145 of the sensor plate is coupled to a coupling cable 148 illustrated in FIG. 11. Considering the rear binding mechanism which is shown in FIG. 11, the coupling cable 148 extends to the corresponding binding mechanism of the front binding, and from the front binding the corresponding coupling cable 149 extends to the binding mechanism 100 which is shown. It will be recognised that the respective ends of the coupling cables 148, 149 which are not shown in the Figures, with an exception which is noted below, are constructed and operate in the same manner as the complementary ends of the cables which are shown. The end of the coupling cable 149 is connected to a dual release latch 150 which is itself connected to a tension spring 152 (see FIG. 11). The dual release latch 150 has a ramp shaped catch 151 formed thereon. Depending upon the tension placed on the coupling cable 149 relative to the strength of the tension spring 152, the catch 151 formed on the dual release latch 150 is able to move past a lower edge 153 formed on the latch member 125. For example, with a binding plate mounted in the front binding the sensor plate thereat is held down which tensions the coupling cable 149 against the bias of the tension spring to thereby place the catch 151 in a position relative to the latch member lower edge 153 as shown in FIG. 11. Then, if a binding plate were also mounted in the rear binding, the rear binding would be in the condition illustrated in FIG. 12. Consider then if the front binding were to undergo a forced release, through a fall of the rider for example. In that instance the binding plate would be released from the front binding through action of one or both of the release blocks on the front binding, and the tension provided by the spring 152 would draw on the coupling cable 149. Because the sensor plate at the front binding is no longer held down by the binding plate, the slidable edge of the sensor plate to which the end of cable 149 is connected would slide and raise the sensor plate. This would result in movement of the dual release latch 150 in the direction to the right as viewed in FIGS. 11 and 12, and cause the catch 151 to bear against the latch member lower edge 153. This causes anti-clockwise rotational movement of the latch member, to thereby release the hammer lug and cause release of the binding mechanism as described above. It will be readily understood that a similar sequence of actions would occur at the front binding if the rear binding were to undergo a forced release. Thus, the dual release operates to release both feet if either undergoes a forced release, as is desirable for safe operation of the binding in the event of a fall or accident during use, for example.

The difference between the binding mechanisms at the front and rear bindings relates to the manual release lever. The manual release lever at the rear binding is provided with a hooked extension 133 (FIG. 11) which engages either the end of the coupling cable 148 or the slidable edge of the sensor plate 140 when the manual release lever 130 is actuated by the user. By engaging the coupling cable 148 or sensor plate 140 upon actuation of the manual release at the rear binding, the coupling cable is prevented from moving when the rear binding plate is voluntarily removed from the rear binding, and so the front binding does not automatically release as in the case of a forced release condition. This enables the user to remove the rear foot from the snowboard to negotiate ski lifts and the like whilst the front foot remains secured to the front binding. Of course in this situation the front binding plate can still undergo a forced release, or can be manually released using the respective manual release lever. Also, when the rear binding plate is returned into engagement with the rear binding, the bindings are again in a condition for automatic dual release in the event of a forced release of either binding. Furthermore, because the front binding manual release lever does not have the hooked extension 133, if the front binding is manually released and the front binding plate disengaged then the rear binding will also release automatically.

The foregoing detailed description of a preferred embodiment of the present invention is in the context of a binding assembly for a snowboard, however it will be readily apparent that the binding assembly may be equally applicable to other forms of recreational or sporting equipment in which the feet of a user are attached to a board, platform or the like. Furthermore, the detailed description of the invention has been presented by way of example only, and is not intended to be considered limiting to the invention as defined in the claims appended hereto. Indeed, an alternative embodiment of the present invention is described in the specification of Australian Patent Application no. PO9546/97, the disclosure of which is expressly incorporated herein by reference.

What is claimed is:

1. A binding apparatus for use with a binding plate secured to or incorporated in the bottom of a respective boot, comprising two binding mechanisms adapted to be secured to a board, platform, the binding mechanisms each comprising a pair of release mechanisms spaced apart in a facing relationship and constructed to, in use, engage at respective sides of the associated binding plate and hold a binding plate to the board, platform, each of the release mechanisms being constructed to release the binding plate from the board upon application of a force to the binding plate with respect to the board which is greater than a respective predetermined threshold in a direction away from the plane of the board or in a rotational sense parallel to the plane of the board, wherein two binding mechanisms are coupled together by way of a cable coupling which interconnects respective release mechanisms of the two binding mechanisms such that, upon release of the binding plate from one of the binding mechanisms, a tension in the cable coupling causes the respective release mechanism of the other binding mechanisms to release the corresponding binding plate therefrom, and wherein each of the binding mechanisms includes a manual release mechanism which acts on one or both of the corresponding release mechanism to voluntarily release the respective binding plate arranged whereby manual release of the binding plate from one of the binding mechanisms causes automatic release of the binding plate from the other binding mechanisms via the cable coupling while manual release of the binding plate from the other of said binding mechanisms prevents an automatic release of the binding plate from said one of the binding mechanisms.

2. A binding apparatus as claimed in claim 1, wherein each release mechanism includes a spring biased cam member which bears against a cam surface of a portion of the binding plate to hold the binding plate to the board, and wherein the cam member is moveable against the spring bias upon application of a respective relative lift-out or rotational force to permit release of the binding plate.

3. A binding apparatus as claimed in claim 1, wherein one of the release mechanisms is constructed to enable the binding plate to be secured in the binding mechanism by application of a force on the binding plate in a direction toward the board.

4. A binding apparatus for securing a binding plate attached to or incorporated in the bottom of a respective boot to a snowboard or the like, comprising two binding mechanisms each having a pair of spaced release mechanisms arranged to, in use, latch onto and secure respective side portions of the associated binding plate when a binding plate is positioned in the binding, each release mechanism having a spring-tensioned release means which permits a forced release of the binding plate upon application to the binding plate of a predetermined separation force or torsional force, the two binding mechanisms being coupled together by way of a cable coupling which, upon application of a change in tension thereto at one of the binding mechanisms, facilitates unlatching of the release mechanism at the other binding mechanism, wherein each binding mechanism further include a sensing means coupled to a respective latch mechanism of the other binding by way of the cable coupling so that, in normal operation, the removal of the binding plate from one of the binding mechanisms facilitates the release of the binding plate from the other binding mechanism, and wherein each binding mechanism includes a manual release mechanism to effect voluntary release of the respective binding plate therefrom arranged whereby the manual release mechanism and cable coupling at one binding mechanism allows release of that foot whilst the other foot remains secured in its binding mechanism, and manual release at the other binding mechanism causes automatic release of both feet.

5. A binding apparatus for use with a binding plate secured to or incorporated in the bottom of a respective boot, comprising two binding mechanisms adapted to be secured to a board, or a platform, the binding mechanisms each comprising a pair of release mechanisms spaced apart in a facing relationship and constructed to, in use, engage at respective sides of the associated binding plate and hold the binding plate to the board, or a platform, wherein each of the binding mechanisms includes a manual release mechanism which acts on one or both of the corresponding release mechanisms to voluntarily release the respective binding plate and wherein the binding mechanisms are coupled together such that manual release of the binding plate from one of the binding mechanisms causes automatic release of the binding plate from the other binding mechanisms while manual release of the binding plate from the other of said binding mechanisms prevents an automatic release of the binding plate from said one of the binding mechanisms.

* * * * *